United States Patent [19]

Kokubu et al.

[11] 3,981,788

[45] Sept. 21, 1976

[54] CAUSTIC ALKALI PRODUCING MULTIPLE VERTICAL DIAPHRAGM TYPE ELECTROLYTIC CELL ADMITTING OF EASY ASSEMBLY

[75] Inventors: Yoshikazu Kokubu; Isao Okazaki; Haruo Shikano, all of Iwaki, Japan

[73] Assignee: Kureha Kagaku Kogyo Kabushiki Kaisha, Tokyo, Japan

[22] Filed: Aug. 18, 1975

[21] Appl. No.: 605,381

[30] Foreign Application Priority Data

Aug. 23, 1974 Japan ..... 49-96833

[52] U.S. Cl. ..... 204/266; 204/269; 204/286; 204/288

[51] Int. Cl.[2] ..... C25B 9/02; C25B 1/26

[58] Field of Search ..... 204/275, 269, 266, 279, 204/286, 288, 289, 297 R, 252, 255

[56] References Cited

UNITED STATES PATENTS

| | | | |
|---|---|---|---|
| 1,485,473 | 3/1924 | Allen | 204/266 X |
| 3,470,083 | 9/1969 | Wrigge et al. | 204/286 X |
| 3,498,903 | 3/1970 | Kamarjan | 204/266 |
| 3,676,315 | 7/1972 | Goens et al. | 204/275 X |
| 3,676,325 | 7/1972 | Smith et al. | 204/286 X |
| 3,912,616 | 10/1975 | Ford | 204/286 |

*Primary Examiner*—John H. Mack
*Assistant Examiner*—A. C. Prescott
*Attorney, Agent, or Firm*—Flynn & Frishauf

[57] ABSTRACT

In a caustic alkali producing multiple vertical diaphragm type electrolytic cell, wherein a plurality of vertical flat box shaped unit anode chamber sets are assembled in parallel in a large cell case acting as a common cathode chamber, each said unit anode chamber set comprising an anode chamber, both main walls of which are formed of a pair of diaphragms and a pair of cathode wire nets stretched on the outside of said diaphragms, and a pair of anode plates received in said anode chamber so as to face said diaphragms, an improvement characterized in that, where the plural unit anode chamber sets are assembled in parallel in the cell case, the cathode wire nets can be electrically connected easily to the cathode bottom plate of said cell case by press-mounting the unit anode chamber sets thereon.

3 Claims, 3 Drawing Figures

CAUSTIC ALKALI PRODUCING MULTIPLE VERTICAL DIAPHRAGM TYPE ELECTROLYTIC CELL ADMITTING OF EASY ASSEMBLY

This invention relates to a caustic alkali producing multiple vertical diaphragm type electrolytic cell, wherein a plurality of vertical flat box-shaped unit anode chamber sets are assembled in parallel in a large cell case acting as a common cathode chamber, each said unit anode chamber set comprising an anode chamber, both main walls of which are formed of a pair of diaphragms and a pair of cathode wire nets stretched on the outside of said diaphragms and a pair of anode plates received in said anode chamber so as to face said diaphragms.

The U.S. Pat. No. 3,883,415 has already provided a multiple vertical diaphragm type electrolytic cell as mentioned above. This proposed electrolytic cell has the advantages that the cathode elements, diaphragms and anode elements of each unit anode chamber set can be accurately assembled in advance outside of an electrolytic cell; since the plural unit anode chamber sets have only to be assembled orderly in a cell case, it is possible easily to carry out the adjustment of a distance between the adjacent anode chamber units which has generally presented considerable difficulties in assembling the cell; and replacement of the used electrodes and diaphragms of each unit anode chamber set by fresh ones can be easily effected outside of the cell by removing the unit cell out of the cell case, thus enabling the cell to be repaired in a relatively short time.

According to the electrolytic cell set forth in said U.S. Pat. No. 3,883,415, however, the cathode conductors fitted to the bottom plate of the cell case and the conductor metal parts electrically connected to the cathode wire nets have to be bolted in place. Therefore, the patented electrolytic cell is still accompanied with the drawbacks that difficulties are encountered in fitting the previously assembled unit anode chamber sets to the cell case or removing them therefrom, and the space between the respective unit anode chamer sets has to be broadened in consideration of the bolting work and in consequence the floor area of the cell should be made large by that extent.

This invention has been accomplished to eliminate the above-mentioned disadvantages. Namely, the electrolytic cell of this invention is characterized in that a plurality of conductor metal parts are spacially fitted in an integral body to the frame of cathode wire nets of each unit anode chamber set at the lower end portion thereof; the outside of both narrow crosswise walls of each unit anode chamber set is fitted with ribbed plates; the inner walls of the cell case or support pillars which are set up between the lengthwise adjacent unit anode chamber set are fitted with counterpart ribbed plates and said both ribbed plates are connected with a tightening metal part, thereby the unit anode chamber sets are pressed against the bottom plate of the cathodic cell case for electrical connection.

This invention can be more fully understood from the following detailed description when taken in conjunction with the accompanying drawings, in which.

Figure 1:
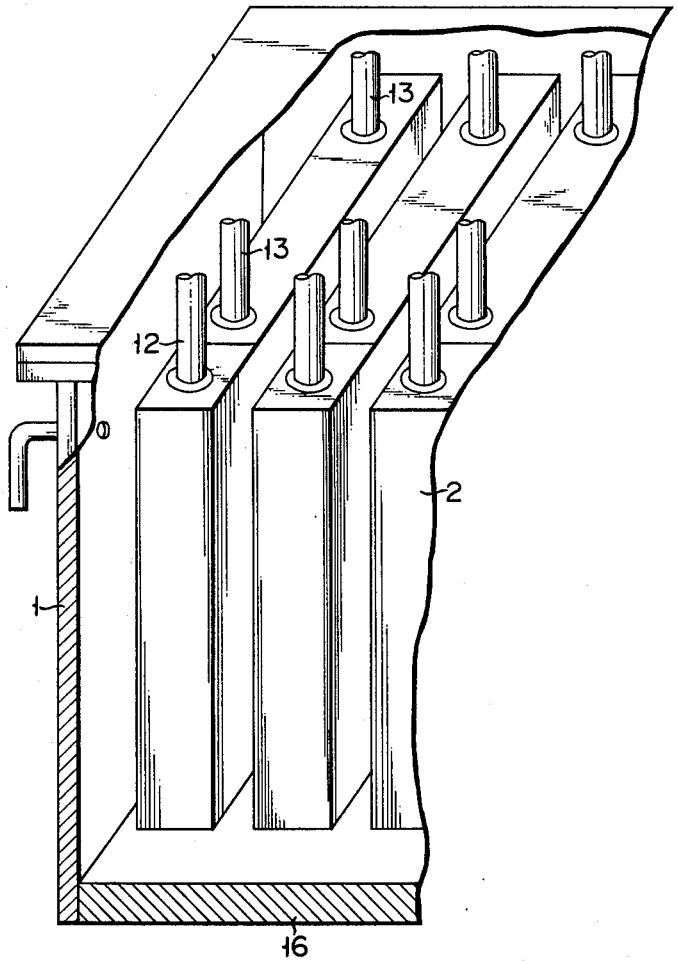
FIG. 1 is a schematic oblique view, partly cut away, of a known caustic soda-producing multiple vertical diaphragm type electrolytic cell, particularly showing the arrangement of the respective unit anode chamber sets.
Figure 2:
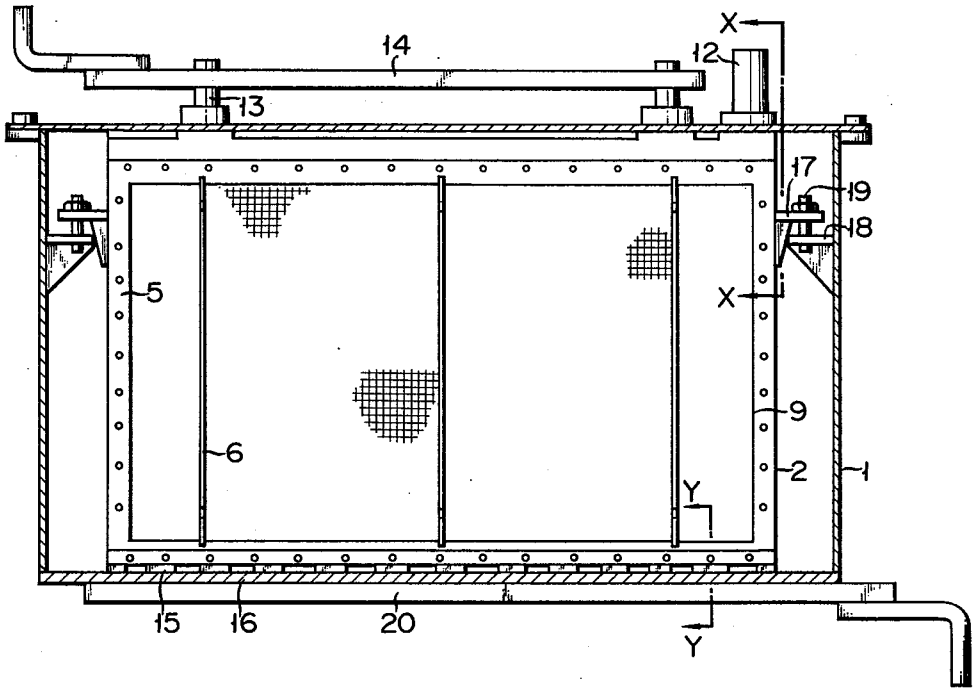
FIG. 2 is a longitudinal sectional view of each unit anode chamber set, showing the construction by which said anode chamber set is mounted on the bottom plate of the case of the electrolytic cell of this invention admitting of easy assembly.
Figure 3:
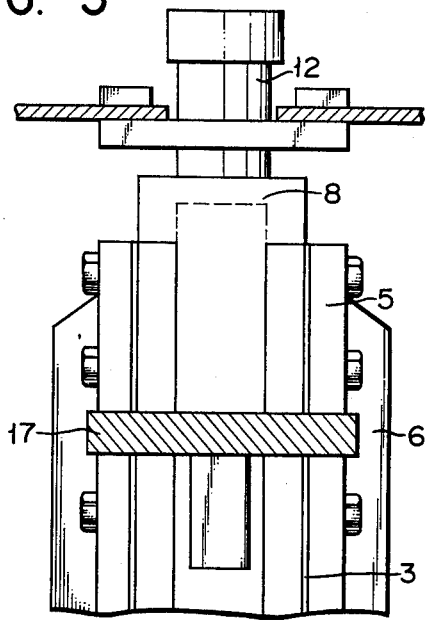
FIG. 3 is an enlarged cross-sectional view of FIG. 2, the upper half showing the X—X plane of FIG. 2 and the lower half indicating the Y—Y plane thereof.
Figure 3:
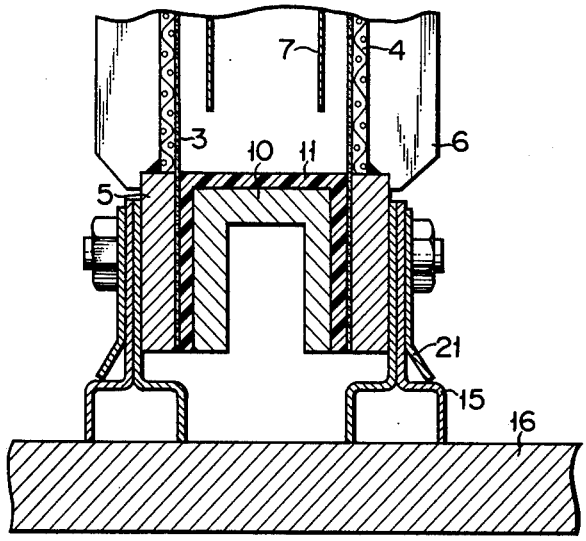

FIG. 1 is a schematic oblique view, partly cut away, of a multiple vertical diaphragm type electrolytic cell of the U.S. Pat. No. 3,883,415, showing a large number of unit anode chamber sets 2 assembled in a cell case 1. Both main walls of each unit anode chamber set 2 are formed, as shown in FIGS. 2 and 3, of a pair of diaphragms 3 prepared from asbestos or synthetic resin and a pair of cathode wire nets 4 made of alkali-resistant and electrically conductive material such as iron, stainless steel or metallic titanium. Said cathode wire nets 4 are disposed on the outside of the diaphragms 3, for example, by being welded or screwed to a frame 5 made of similar alkali-resistant and electrically conductive material. The cathode wire nets 4 are each supported, if necessary, by ribs 6 (FIGS. 2 and 3). Each anode chamber contains a pair of anode plates 7 made of, for example, platinum-coated chlorine-resistant conductor material such as titanium and so disposed as to closely face the paired diaphragms 3. The ceiling 8 (FIG. 3), both crosswise walls 9 (FIG. 2) and the bottom plate 10 (FIG. 3) of the anode chamber are formed of a sufficiently thick plate to allow the cathode frame 5 to be fitted to the side walls of these members. Those walls of said members 8, 9, 10 which are exposed to the interior of the anode chamber or contact the diaphragms are lined or coated with chlorine-resistant material 11 (FIG. 3) such as rubber, chlorinated polyvinyl chloride, polyvinylidene fluoride, poly-monochlorotrifluoroethylene, polyethylene tetrafluoride or fluorinated rubber. Referential numeral 12 is a pipe concurrently acting as outlet means for gas held in the anode chamber and inlet means for brine. This pipe 12 communicates with a gas-separating tank (not shown) positioned on the cell case 1. However, separate gas outlet and brine inlet may be provided. Referential numeral 13 denotes a plurality of anode lead rods jointly connected to a common anode bus bar 14.

The electrolytic cell of this invention has the same construction as the U.S. Pat. No. 3,883,415 up to the above-mentioned point. However, the present electrolytic cell is characterized in that it further comprises a novel construction as later described. Namely, a large number of conductor metal parts 15 (FIG. 3) are spatially fitted to both lengthwide edges of the lower end portion of the frame 5 which supports the cathode wire nets 4. Each of said conductor metal parts 15 is formed of a 2-ply iron laminate, the lower end portion of which is branched into two parts having some elasticity. Obviously, the conductor metal part 15 may take any other form than described above. Each unit anode chamber set is mounted on the bottom plate 16 (FIGS. 2 and 3) of the cell case 1 through the conductor metal parts 15. That lower end portion of the conductor metal part 15, which is electrically connected to the bottom plate 16 of the cell case 1, is usually the same material as the upper portion, but the end portion may be formed of particularly good conductor material such as silver or copper. Referential numeral 21 denotes spring type auxiliary metal parts for tightly attaching the conductor metal parts 15 to the frame 5.

Ribbed plates 17 are welded to both crosswise walls of each unit anode chamber set, and the inner walls of the cell case are fitted with counterpart ribbed plates 18. Both ribbed plates 17 and 18 are connected with a tightening metal part 19. As the result, the forked lower portion of the conductor metal part 15 fixed to the underside of the unit anode chamber set is tightly pressed against the bottom plate 16 of the cell case 1, attaining full electrical connection between said conductor metal part 15 and the bottom plate 16. Referential numeral 20 (FIG. 2) is a cathode bus bar connected to the bottom plate 16 of the cell case 1.

Where a large number of unit anode chamber sets are assembled in two or more parallel rows, it is impossible to fix one or both narrow crosswise walls of every unit anode chamber set to the inner walls of the cell case. In such case, it is advised to set up support pillars on the bottom plate 16 at the positions between the lengthwise adjacent unit anode chamber sets and attach anode chamber-fixing metal parts to said support pillar. This arrangement enables the respective anode chamber sets to be assembled in substantially the same manner as previously described.

With the electrolytic cell of this invention, any unit anode chamber set can be easily removed from the cell case or fixed therein simply by pulling out the nut-head bar 19 from the holes of the ribbed plates 17 and 18 or inserting the bar into said holes. Further, absence of any metal part for fixing the conductor metal parts 15 to the bottom plate 16 of the cell case enables a space between the adjacent unit anode chamber sets and consequently the total floor area of the electrolytic cell to be considerably decreased.

This invention will be more fully understood by reference to the following description of one example.

A plurality of conductor metal parts each formed of two laminated iron plates respectively measuring 1.6 mm in thickness and branched at the lower end part were spatially fitted, as shown in FIGS. 2 and 3, to both lengthwise edge portions of the bottom plate of a unit anode chamber set, each side wall of which was fitted with a cathode wire net 125 cm wide and 90 cm high to provide a vertical diaphragm type electrolytic cell for production of caustic soda. Electrolysis was carried out by introducing 10,000 ampere current through the cell. In this case, electric resistance between the conductor metal parts and the bottom plate of the cell case was only 6 millivolts.

What we claim is:

1. In a caustic alkali-producing multiple vertical diaphragm type electrolytic cell, wherein a plurality of vertical flat box-shaped unit anode chamber sets are assembled in parallel in a cathodic cell case, each said unit anode chamber set comprises main walls formed of a pair of diaphragms and a pair of cathode wire nets stretched on the outside of said diaphragms, and a pair of anode plates received in said anode chamber so as to face said diaphragms, an improvement characterized in that a plurality of conductor metal parts are spatially fitted to the frame of cathode wire nets of each unit anode chamber set at the lower end portion thereof; the outsides of both narrow crosswise walls of each unit anode chamber set are fitted respectively with a ribbed plate; the inner walls of the cell case are fitted with counterpart ribbed plates; and said both ribbed plates are connected with a tightening metal part, to press the unit anode chamber sets against the bottom plate of the cathodic cell case for electrical connection.

2. The electrolytic cell of claim 1, wherein each of the conductor metal parts spatially fitted to the frame of cathode wire nets is formed of a two-ply iron laminate, the lower end portion of which is branched into two parts.

3. The electrolytic cell of claim 1, wherein support pillars are set up on the bottom plate of cell case at the positions between the lengthwise adjacent unit anode chamber sets when a large number of unit anode chamber sets are assembled in two or more parallel rows, and ribbed plates are welded to both crosswise sides of said pillars so as to connect the ribbed plates fitted to the lengthwise adjacent unit anode chamber sets thereto.

* * * * *

UNITED STATES PATENT OFFICE
CERTIFICATE OF CORRECTION

PATENT NO. : 3,981,788
DATED : September 21, 1976
INVENTOR(S) : Yoshikazu KOKUBU It is certified that error appears in the above-identified patent and that said Letters Patent are hereby corrected as shown below:

Column 4 (claim 3), line 34, after "wherein" insert --a plurality of unit anode chamber sets are assembled in two or more parallel rows,--;

line 35, after "bottom plate of" insert --the--;

line 37, after "chamber sets" delete the remainder of the line;

delete line 38;

line 40, before "pillars" insert --support--.

Signed and Sealed this
Thirtieth Day of November 1976

[SEAL]

*Attest:*

RUTH C. MASON
*Attesting Officer*

C. MARSHALL DANN
*Commissioner of Patents and Trademarks*